US006422215B1

(12) United States Patent
McKay et al.

(10) Patent No.: US 6,422,215 B1
(45) Date of Patent: Jul. 23, 2002

(54) EXHAUST GAS RE-CIRCULATION SYSTEM WITH AN INTEGRATED CATALYTIC CONVERTER

(75) Inventors: Daniel Lee McKay, Brighton; Gary Arthur Nichols, Farmington Hills, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/550,544

(22) Filed: Apr. 14, 2000

(51) Int. Cl.[7] ..... F02M 25/07
(52) U.S. Cl. ..... 123/568.11; 123/568.12
(58) Field of Search ..... 123/568.11, 568.12, 123/568.17, 568.18, 568.19, 568.2; 60/278, 279

(56) References Cited

U.S. PATENT DOCUMENTS 1,975,619 A * 10/1934 Rector ..... 123/568.12
2,696,202 A * 12/1954 MacDonald ..... 123/568.11
4,294,220 A * 10/1981 Yasuhara et al. ..... 60/278
5,207,734 A * 5/1993 Day et al. ..... 60/278
5,517,976 A * 5/1996 Bachle et al. ..... 123/568.11
5,592,925 A * 1/1997 Machida et al. ..... 123/568.11
5,785,030 A * 7/1998 Paas ..... 123/568.12
6,065,456 A * 5/2000 Miyoshi et al. ..... 123/568.2

OTHER PUBLICATIONS

US 6,095,122, 08/2000, Everingham (withdrawn)*

* cited by examiner

*Primary Examiner*—Willis R. Wolfe
(74) *Attorney, Agent, or Firm*—John VanOphem

(57) ABSTRACT

An exhaust gas re-circulation (EGR) system is provided for use in conjunction with an internal combustion engine. The EGR system includes an intake manifold, an exhaust manifold, a passageway connected in flow communication between the exhaust manifold and the intake manifold, and an EGR valve interposed in the passageway for controlling re-circulation of exhaust gas into the intake manifold. In addition, an emissions control device (e.g., a catalytic converter) for reducing exhaust emissions in the gas flowing into the intake manifold is connected in flow communication with the EGR valve.

8 Claims, 2 Drawing Sheets

EXHAUST GAS RE-CIRCULATION SYSTEM WITH AN INTEGRATED CATALYTIC CONVERTER

TECHNICAL FIELD

The present invention relates generally to an exhaust gas re-circulation (EGR) system for use in conjunction with an internal combustion engine and, more particularly, to an EGR system having a small integrated catalytic converter.

BACKGROUND OF THE INVENTION

It is well known in the automotive engine art to provide an exhaust gas re-circulation (EGR) system for use in conjunction with an internal combustion engine. Generally, EGR systems are used to redirect portions of the exhaust gas and fuel consumption in the exhaust manifold back into the intake manifold, thereby lowering exhaust emissions.

Therefore, it is desirable to provide an EGR system that improves fuel economy by increasing thermal efficiency and by reducing pumping loss.

SUMMARY OF THE INVENTION

In accordance with the present invention, an exhaust gas re-circulation (EGR) system is provided for use in conjunction with an internal combustion engine. The EGR system includes an intake manifold, an exhaust manifold, a passageway connected in flow communication between the exhaust manifold and the intake manifold, and an EGR valve interposed in the passageway for controlling re-circulation of exhaust gas into the intake manifold. In addition, an emissions control device (e.g., a catalytic converter) for reducing exhaust emissions in the gas flowing into the intake manifold is connected in flow communication with the EGR valve.

In another aspect of the present invention, an EGR manifold is provided for distributing exhaust flowing into the intake manifold. The EGR manifold resides in the intake manifold and is connected in flow communication with the EGR valve.

For a more complete understanding of the invention, its objects and advantages, refer to the following specification and to the accompanying drawings.

DESCRIPTION OF THE PREFERRED EMBODIMENT

Figure 1:
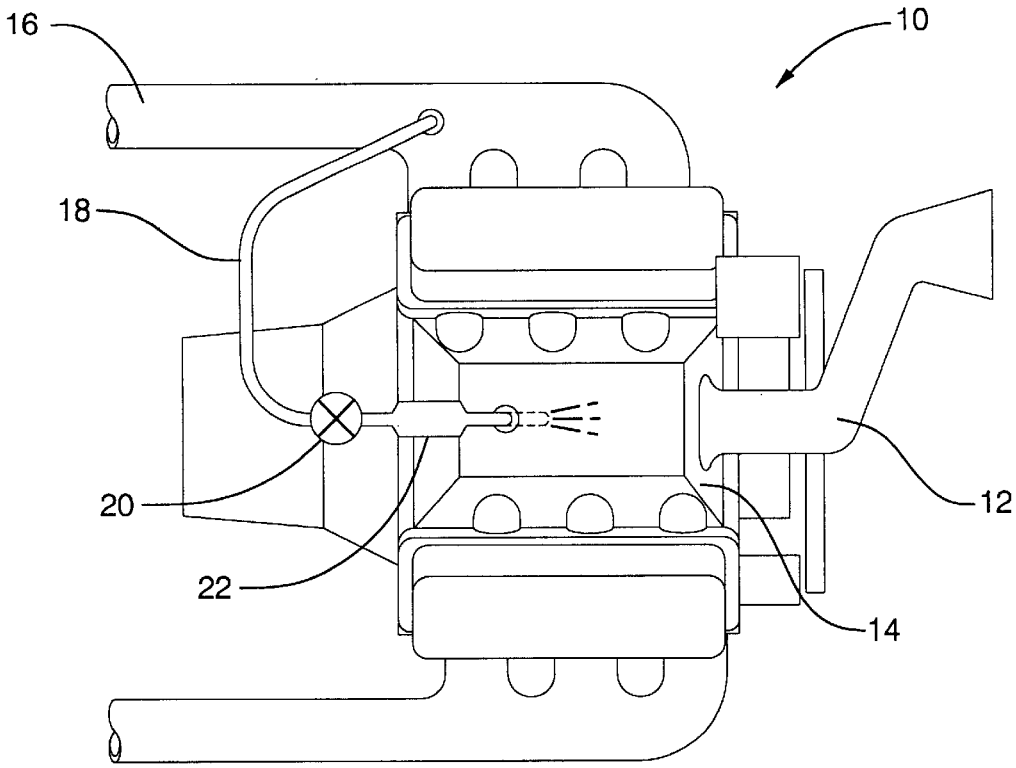
FIG. 1 is a diagram of a preferred embodiment of an exhaust gas re-circulation (EGR) system, having an integrated catalytic converter residing in the intake manifold, in accordance with the present invention.

An exhaust gas re-circulation (EGR) system 10 embodying features of the present invention is depicted in FIG. 1. An EGR system 10 generally includes an air inlet tube 12, an intake manifold 14, an exhaust manifold 16, a passageway 18 connected between the exhaust manifold 16 and the intake manifold 14, and an EGR valve 20 interposed in the passageway 18 for controlling re-circulation of exhaust gas into the intake manifold 14. While the following description is provided with reference to a typical EGR system, it is readily understood that the broader aspects of the present invention are applicable to other types of and/or configurations for the EGR system 10.

In accordance with the present invention, an emissions control device 22, such as a catalytic converter, for reducing exhaust emissions in the gas flowing into the intake manifold 14 is connected in flow communication with the EGR valve 20. Referring to FIG. 1, the emissions control device 22 resides inside the intake manifold 14. In particular, an inlet 24 of the emissions control device 22 is connected to the outlet end of the EGR valve 20. When the emissions control device 22 is positioned downstream from the EGR valve 20, the flow requirements of the EGR valve 20 may be reduced as the expanding exhaust gas displaces more cylinder volume. One skilled in the art will readily recognize that any conventional catalytic convert may be used as the emissions control device 22.

In operation, clean air enters the inlet tube 12 and flows into the intake manifold 14. After combustion occurs in the engine, exhaust gas is released into the exhaust manifold 16. At least a portion of the exhaust gas enters the EGR system 10 through an inlet in the passageway 18 connected between the exhaust manifold 16 and the intake manifold 14. As will be apparent to one skilled in the art, the EGR valve 20 regulates the flow of exhaust gas through the passageway 18.

Exhaust gas then passes through the emissions control device 22 and into the intake manifold 14. The temperature of the exhaust gas is significantly increased as it passes through the emissions control device 22. As a result, the heated exhaust gas entering the intake manifold 14 heats the intake charge, thereby reducing the pumping losses. It should be noted that the catalytic action reduces the contaminants (e.g., acids and particulates) in the exhaust gases to inert gases, reducing engine wear and improving engine durability.

In a conventional EGR system, high thermal efficiency is achieved by raising the intake manifold pressure at a constant engine torque which in turn reduces the pumping work. In the EGR system 10 of the present invention, higher thermal efficiencies are achieved by increasing the inlet charge temperature, thereby further reducing pumping work. With a higher temperature, the charge required to generate the desired torque must be at a higher pressure to fit in the cylinder volume. Thus, the EGR system 10 of the present invention improves fuel economy by reducing pumping loss and increasing thermal efficiency.

Figure 2:
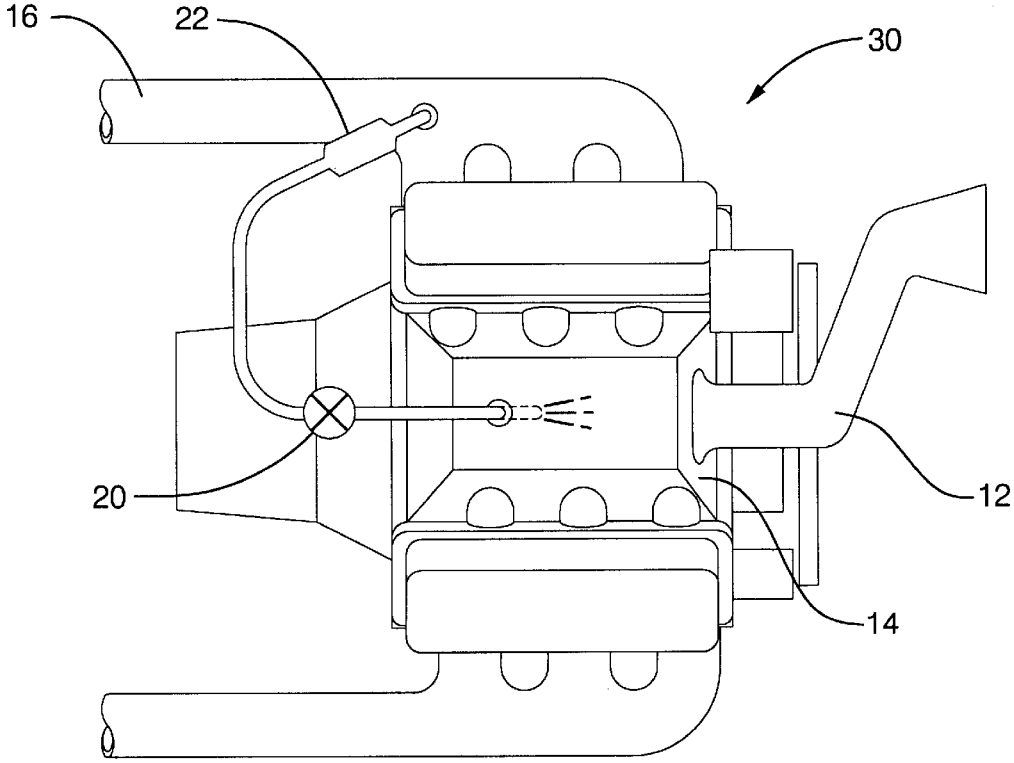
FIG. 2 is a diagram of an alternative preferred embodiment of the EGR system, having the integrated catalytic converter residing in the exhaust manifold, in accordance with the present invention.

An alternative embodiment of an EGR system 30 in accordance with the present invention is shown in FIG. 2. In this embodiment, the emissions control device 22 is placed inside the exhaust manifold 16, such that an outlet of the emissions control device 22 is connected to the inlet end of the EGR valve 20. Due to the exhaust heating, the catalyst always remains at operating temperature. This alternative embodiment otherwise operates the same as was described in relation to FIG. 1.

Figure 3:
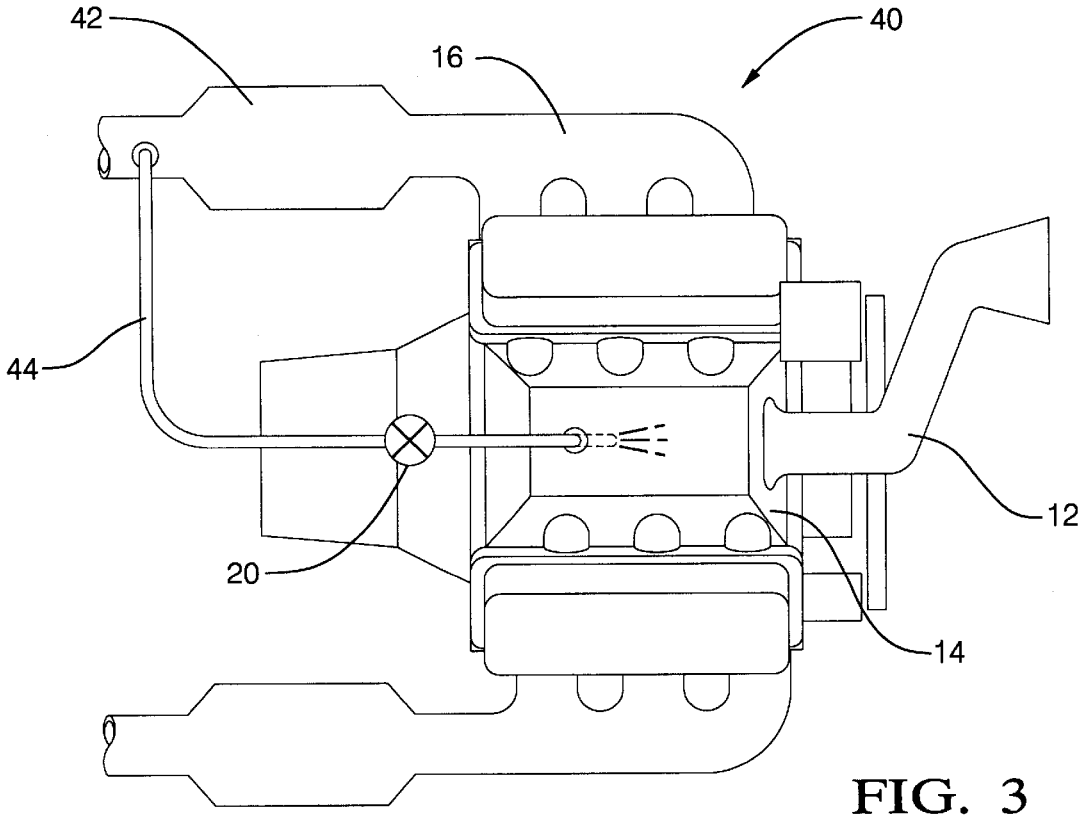
FIG. 3 is a diagram of another alternative preferred embodiment of the EGR system, having a passageway connected downstream from the conventional catalytic converter to the intake manifold, in accordance with the present invention.

Another alternative embodiment of an EGR system 40 is depicted in FIG. 3. In this case, a conventional catalytic converter 42 is used to heat and clean the exhaust gas being re-circulated into the intake manifold 14. A passageway 44 is connected downstream from the conventional catalytic converter 42. Thus, there is no need to integrate an additional emissions control device into this EGR system 40. Again, this embodiment otherwise operates the same as was described in relation to FIG. 1. In each of these alternative embodiments, because heating is done before entering a restriction and a flow throttling valve, there is minimal reduction in pumping loss. However, in these embodiments there is cleaner exhaust recirculation which reduces engine deposits and improves the capability to use EGR manifolds.

Figure 4:
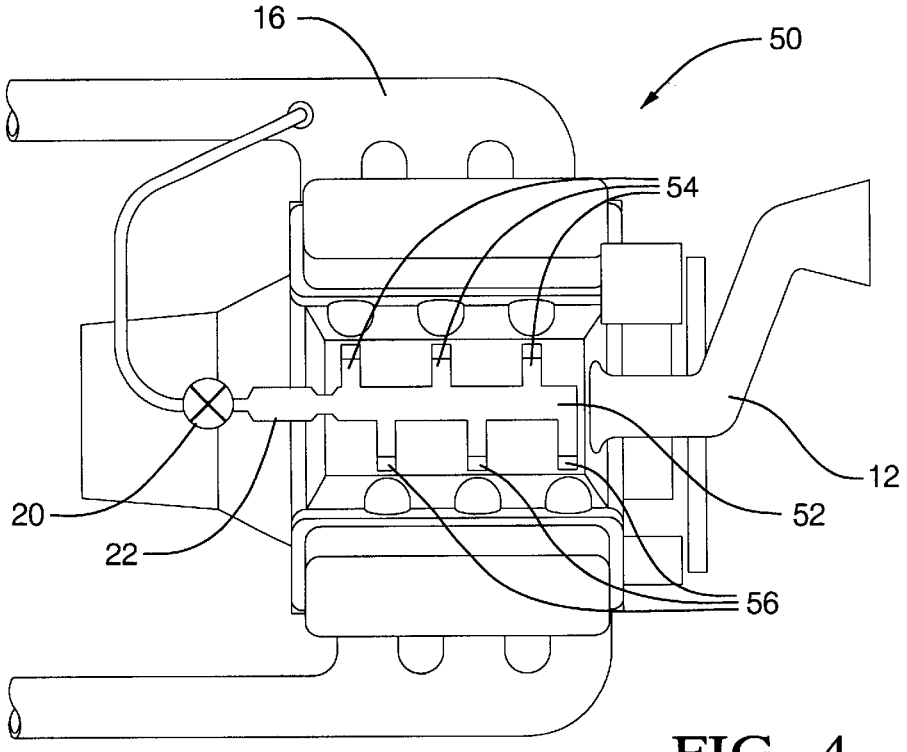
FIG. 4 is a diagram of yet another alternative preferred embodiment of the EGR system incorporating an EGR manifold into the intake manifold, in accordance with the present invention.

A preferred embodiment of an EGR system 50 of the present invention is shown in FIG. 4. This embodiment differs from FIG. 1 in that the emissions control device 22 is disposed in the passageway 18 prior to the intake manifold 14, and an EGR manifold 52 for distributing exhaust gas is incorporated into the intake manifold 14. The EGR manifold 52 includes an inlet connected to the outlet end of the emissions control device 22 and a plurality of outlets 54 which extend into the intake manifold 14. In this way, the EGR manifold 52 improves the distribution of exhaust gas to each of the engine cylinders. The EGR manifold 52 may further include a poppet valve 56 or other pressure differential valve disposed at the end of each outlet 54. It is envisioned that other types of valves may also be used to cap each outlet. By controlling the distribution of the exhaust gas through the use of poppet valves 56, the present invention reduces the lag time need to purge the intake manifold during transient engine conditions. For instance, a maximum power request may be delayed if the EGR is displacing air which could otherwise generate power. In a conventional EGR system, residual exhaust gas must be completely purged from the intake manifold prior to certain engine operating conditions.

While the above description constitutes the preferred embodiment of the invention, it will be appreciated that the invention is susceptible to modification, variation, and change without departing from the proper scope or fair meaning of the accompanying claims.

What is claimed is:

1. An exhaust gas re-circulation (EGR) system for use with an internal combustion engine, the internal combustion engine having an intake manifold and an exhaust manifold, comprising:

a passageway connected in flow communication between the intake manifold and the exhaust manifold;

an EGR valve interposed in the passageway for controlling re-circulation of exhaust gas into the intake manifold; and an emissions control device connected in flow communication with the EGR valve for heating the intake charge and reducing exhaust emissions in the exhaust gas flowing into the intake manifold wherein the emissions control device resides in the intake manifold.

2. An exhaust gas re-circulation (EGR) system for use with an internal combustion engine, the internal combustion engine having an intake manifold and an exhaust manifold, comprising:

a passageway connected in flow communication between the intake manifold and the exhaust manifold;

an EGR valve interposed in the passageway for controlling re-circulation of exhaust gas into the intake manifold; and an emissions control device connected in flow communication with the EGR valve for heating the intake charge and reducing exhaust emissions in the exhaust gas flowing into the intake manifold wherein the emissions control device resides in the exhaust manifold.

3. An exhaust gas re-circulation (EGR) system for use with an internal combustion engine, the internal combustion engine having an intake manifold and an exhaust manifold, comprising:

a passageway connected in flow communication between the intake manifold and the exhaust manifold;

an EGR valve interposed in the passageway for controlling re-circulation of exhaust gas into the intake manifold;

an emissions control device connected in flow communication with the EGR valve for heating the intake charge and reducing exhaust emissions in the exhaust gas flowing into the intake manifold; and an EGR manifold residing in the intake manifold for distributing exhaust flowing therein, the EGR manifold having an inlet connected in flow communication with the passageway and a plurality of outlets in flow communication with the intake manifold, the EGR manifold disposed downstream of the EGR valve.

4. An exhaust gas re-circulation (EGR) system for use with an internal combustion engine, the internal combustion engine having an intake manifold and an exhaust manifold, comprising:

a passageway connected in flow communication between the intake manifold and the exhaust manifold;

an EGR valve interposed in the passageway for controlling re-circulation of exhaust gas into the intake manifold;

an emissions control device connected in flow communication with the EGR valve for heating the intake charge and reducing exhaust emissions in the exhaust gas flowing into the intake manifold;

an EGR manifold residing in the intake manifold for distributing exhaust flowing therein, the EGR manifold having an inlet connected in flow communication with the passageway and a plurality of outlets in flow communication with the intake manifold; and a valve disposed on each outlet of the EGR manifold.

5. An exhaust gas re-circulation (EGR) system for use with an internal combustion engine, the internal combustion engine having an intake manifold and an exhaust manifold, comprising:

a catalytic converter positioned downstream from the exhaust manifold for reducing exhaust emissions;

a passageway connected downstream from the catalytic converter to the intake manifold;

an EGR valve interposed in the passageway for controlling re-circulation of exhaust gas into to intake manifold;

an EGR manifold for distributing exhaust gas flowing into the intake manifold, the EGR manifold having an inlet connected to an outlet of the EGR valve and a plurality of outlets extending into the intake manifold; and a valve disposed on each outlet of the EGR manifold.

6. An exhaust gas re-circulation (EGR) system for use with an internal combustion engine, the internal combustion engine having an intake manifold and an exhaust manifold, comprising:

an EGR valve for controlling re-circulation of exhaust gas into the intake manifold, the EGR valve having an inlet and an outlet, where the inlet of the EGR valve is connected to the exhaust manifold;

an emissions control device for reducing exhaust emissions in the exhaust gas flowing into the intake manifold, the emissions control device having an inlet and an outlet, where the inlet of the emissions control device is connected to the outlet of the EGR valve;

an EGR manifold for distributing exhaust gas flowing into the intake manifold, the EGR manifold having an inlet connected to the outlet of the emissions control device and a plurality of outlets extending into the intake manifold; and a valve disposed on each outlet of the EGR manifold.

7. An exhaust gas re-circulation (EGR) system for use with an internal combustion engine, the internal combustion engine having an intake manifold and an exhaust manifold, comprising:

an EGR valve for controlling re-circulation of exhaust gas into the intake manifold, the EGR valve having an inlet and an outlet, where the inlet of the EGR valve is connected to the exhaust manifold;

an emissions control device for reducing exhaust emissions in the exhaust gas flowing into the intake manifold, the emissions control device having an inlet and an outlet, where the inlet of the emissions control device is connected to the outlet of the EGR valve; and an EGR manifold for distributing exhaust gas flowing into the intake manifold, the EGR manifold disposed downstream of the EGR valve and having a plurality of outlets extending into the intake manifold.

8. A method for reducing exhaust emissions within an exhaust gas re-circulation (EGR) system of an internal combustion engine, the EGR system having an intake manifold and an exhaust manifold, comprising the steps of:

providing an EGR passageway connected between the exhaust manifold and the intake manifold;

controlling re-circulation of exhaust gas into the intake manifold through the use of an EGR valve interposed in the EGR passageway;

passing the exhaust gas through an emissions control device connected to the EGR valve, thereby providing heat to the intake charge and reducing emissions within the EGR system;

distributing the exhaust gas from the emission control device through an EGR manifold; and controlling the distribution of exhaust gas to each cylinder of said engine through the use of a valve disposed on each outlet of said EGR manifold.

* * * * *